United States Patent [19]

Novosel et al.

[11] 4,199,467

[45] Apr. 22, 1980

[54] ALKALINE DISHWASHER DETERGENT

[75] Inventors: Gerald W. Novosel, Cincinnati; Lawrence A. Gilbert, Fairfield; Maria L. S. Wee; Frank J. Mueller, both of Cincinnati, all of Ohio

[73] Assignee: The Procter & Gamble Company, Cincinnati, Ohio

[21] Appl. No.: 902,577

[22] Filed: May 4, 1978

[51] Int. Cl.[2] ..... C11D 7/56

[52] U.S. Cl. ..... 252/103; 252/95; 252/99; 252/135; 252/187 C; 8/108 R

[58] Field of Search ..... 252/103, 95, 99, 187 A, 252/187 C, 135; 8/108 R

[56] References Cited

U.S. PATENT DOCUMENTS

| | | | |
|---|---|---|---|
| 3,598,743 | 8/1971 | Coates | 252/99 |
| 3,600,371 | 8/1971 | Lintner | 252/99 |
| 3,630,923 | 12/1971 | Simmons et al. | 252/99 |
| 3,656,890 | 8/1972 | Toy et al. | 252/99 |
| 3,696,041 | 10/1972 | Gray | 252/99 |

*Primary Examiner*—Mayer Weinblatt

*Attorney, Agent, or Firm*—Robert B. Aylor; Richard C. Witte; Thomas H. O'Flaherty

[57] ABSTRACT

Alkaline dishwasher detergent composition having a specific critical pH; a specific mixture of alkali metal silicates for corrosion prevention, improved spotting and filming, and improved processing and physical characteristics; and having a relatively high level of surfactant. The detergent composition is substantially free of highly alkaline materials and organic builders.

18 Claims, No Drawings

ALKALINE DISHWASHER DETERGENT

TECHNICAL FIELD

This invention relates to detergent compositions which are particularly suitable for use in automatic dishwashers. Such compositions are normally alkaline, contain low levels of low foaming surfactants, and contain a source of available chlorine. In order to obtain good cleaning performance, the disclosed compositions quite often contain a source of alkalinity which gives a pH greater than 12 at a 1% concentration or large amounts of phosphate builders or organic builders. However, it is known that sources of alkalinity such as alkali metal metasilicates and alkali metal hydroxides are relatively unsafe for inclusion in large amounts in a consumer product. Also, it is desirable to try to lower the amount of phosphorus contained in such compositions.

DISCLOSURE OF THE INVENTION

This invention is based upon the discovery that a series of modifications in conventional, automatic dishwasher compositions can give surprisingly optimal cleaning and spotting and filming results and improved processing and physical characteristics, while increasing the safety of the compositions and lowering the amount of phosphorus required for a given level of performance. More specifically, this invention relates to automatic dishwasher compositions providing optimum cleaning and spotting and filming and physical characteristics and consisting essentially of:

(1) from about 20% to about 60%, preferably from about 25% to about 50%, of a detergency builder selected from the group consisting of alkali metal (e.g., sodium or potassium) tripolyphosphates, pyrophosphates, orthophosphates, carbonates and mixtures thereof;

(2) from about 30% to about 38% silicate representing from about 10% to about 15%, preferably from about 12% to about 13% of $SiO_2$, the silicate being a mixture of alkali metal (sodium or potassium, preferably sodium) silicates of which (a) from about 6% to about 15%, preferably from about 6% to about 12% based on the total formula is present as hydrous silicate having an $SiO_2$:$M_2O$ ratio of from about 2.0 to about 3.2, preferably 2.4, and a solids content of from about 75% to about 85% and (b) the remainder of the silicate is a mixture of 2.0 r and 3.0 to 3.6 r, preferably 3.2 r, silicates with from about 15% to about 50% of the total $SiO_2$, preferably from about 25% to about 40% of the $SiO_2$ being provided by the 2.0 r silicate and from about 10% to about 50%, preferably from about 25% to about 40% of the $SiO_2$ being in the higher ratio silicates, and wherein M is selected from the group consisting of Na and K;

(3) available chlorine at a level of from about 0.5% to about 3%, preferably from about 0.7% to about 1.5%; and (4) from about 5% to about 9.5%, preferably from about 6% to about 8%, most preferably from about 6.5% to 7.5%, of a low foaming nonionic surfactant, said composition having a pH of from about 10.4 to 10.9 at 2,500 ppm and being substantially free, i.e., less than about 10%, preferably less than about 5%, and most preferably entirely free of materials having a pH of 12 or more at a concentration of 1% in water and also being substantially free, i.e., less than about 10%, preferably less than 5% and most preferably completely free of organic chelating builders.

The above compositions give optimal cleaning, superior spotting, and optimal filming characteristics and improved processing and physical characteristics, using less phosphorus and less very highly alkaline materials than is required by the prior art to give equivalent levels of performance.

DETAILED DESCRIPTION OF THE INVENTION

The Detergency Builder

It is desirable that at least 20% of the composition is either sodium or potassium tripolyphosphate or sodium or potassium pyrophosphate or mixtures thereof in order to provide good cleaning and spotting and filming (S/F) results. Since it is desirable to keep the phosphorus content of the composition as low as possible, it is preferred to use a level of from about 20% to about 35%, preferably 25% to 30%, of these sequestering phosphate builders although increased levels up to 50% provide performance benefits. As the amount of sequestering phosphate builder is reduced below about 20%, the level of performance drops off drastically. In general, one would like to use as much of sequestering phosphate builder as possible given the limits that are permitted in formulation. The preferred sequestering phosphate builder is sodium tripolyphosphate.

In addition to serving as a sequestering builder, sequestering phosphate builders also are sources of alkalinity and buffering materials. They also are major sources of hydration capacity which assists in making the composition free-flowing initially and maintaining the free-flowing characteristics during storage.

The composition may also contain from about 5% and up to about 15% of trisodium orthophosphate either as trisodium orthophosphate or as chlorinated trisodium orthophosphate. The trisodium phosphate is also a buffering material which can help provide the relatively high alkaline pH in use that is required for optimum performance while still maintaining the safety of the composition at the highest possible level.

The term "chlorinated trisodium phosphate" designates a composition consisting of trisodium phosphate and sodium hypochlorite in intimate association in the crystalline form. The chlorinated trisodium phosphate can contain from 1% to 5% available chlorine calculated on the basis of the hydrated material and can conveniently be prepared by the methods of U.S. Pat. No. 1,555,474 or 1,965,304 or modifications thereof, incorporated herein by reference. It is preferable to use the trisodium phosphate as the chlorinated trisodium phosphate. If one does not use the chlorinated trisodium phosphate, it is usually necessary to incorporate an organic chlorine bleach component. Also, it is desirable to keep the amount of extraneous organic material in the composition as low as possible.

Other builders include sodium and potassium carbonate which are sources of alkalinity (buffers) in the proper pH range.

The Source of Available Chlorine

The source of available chlorine is a chlorine bleach component, a compound which contains chlorine in active form. Such compounds are often characterized as hypochlorite compounds and are well known as a class. It has been found that the compositions of this invention should have a source of available chlorine in an amount sufficient to provide available chlorine equal to about 0.5% to about 3% by weight of the composition. A more preferred level is from about 0.7% to about 1.5% by weight of the composition. A high level of available chlorine helps the cleaning, especially on starchy soils, and improves spotting and filming.

As stated before, a preferred source of available chlorine is chlorinated trisodium phosphate. However, other materials which can be used are: sodium and potassium dichlorocyanurates, dichlorocyanuric acid; 1,3-dichloro-5,5-dimethyl hydantoin; N,N'-dichlorobenzoylene urea; paratoluene sulfondichloroamide; trichloromelamine; N-chloroammeline; N-chlorosuccinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Of the other materials sodium, and especially potassium dichlorocyanurates are preferred for effectiveness, stability, availability, etc.

The Silicate

The compositions of this invention contain from about 10% to about 15%, preferably from about 12% to about 13%, of $SiO_2$ as a mixture of sodium or potassium silicates, preferably sodium silicates. These alkali metal silicates comprise from about 30% to about 38% of the composition. From about 6% to about 15%, preferably from about 6% to about 12% by weight of the composition is a hydrous silicate having a ratio of $SiO_2$:$M_2O$ (M=Na or K) of from about 2 to about 3.2, preferably 2.4 and a solids content of from about 75% to about 85%. This hydrous silicate at the indicated levels provides $SiO_2$ and provides a desirable balance between agglomerating characteristics and the ability to form free-flowing, non-caking agglomerates while avoiding formation of excessive insolubles. It is also desirable to use as much two ratio (2.0 r) silicate as possible in the remaining mixture of 2.0 r and 3.0 r to 3.6 r silicates for best overall performance as far as spotting and filming (S/F) is concerned on metal surfaces, as disclosed in the copending U.S. Patent Application Ser. No. 849,206 of Barford et al, filed Nov. 7, 1977, now abandoned, said application being incorporated herein by reference. However, in order to provide good materials protection, it is desirable to have at least 10% and up to 50% of the total $SiO_2$ present in the composition as the higher ratio (3.0 r to 3.6 r) silicate, preferably a 3.2 r silicate.

The Surfactant

It has been found, surprisingly, that at least about 5%, and not more than about 9.5%, of a low sudsing surfactant is required in order to provide optimum cleaning and S/F (spotting and filming characteristics). Care must be taken that the surfactant level is not too high for S/F reasons as shown hereinafter. A preferred level of surfactant is from about 6% to about 8% and an even more preferred level of surfactant is from about 6.5% to about 7.5% by weight of the composition. Preferably, the surfactant is a conventional alkoxylated, preferably ethoxylated, nonionic surfactant and preferably the composition is essentially free of sulfonated or sulfated anionic surfactants.

Examples of nonionic surfactants include:

(1) the condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, and being substantially free of chain lengths above and below these numbers, with from about 6 to about 15 moles, preferably 7 to 12 moles, most preferably 9 moles, of ethylene oxide provides superior S/F performance. More particularly, it is preferred that the fatty alcohol contain 18 carbon atoms and be condensed with from about 7.5 to about 12, preferably about 9, moles of ethylene oxide. It is even more preferred if the distribution of ethylene oxide condensation products is such as to give more than about 40%, preferably more than about 50% of the product within plus or minus two ethylene oxide moieties from the average. The preferred product contains less than about 2% unethoxylated alcohol and more than about 70% should contain less than about 10 ethoxy moieties. This distribution of ethylene oxide analogs can be obtained by using a high level of a very strong alkaline catalyst such as sodium metal or sodium hydride in e.g., a 1:1 molar ratio of catalyst to alcohol or by stripping a conventional ethoxylated alcohol. These various specific $C_{17}$–$C_{19}$ ethoxylates give extremely good performance even at lower levels (e.g., about 5%) and at the higher levels (about 9%) are sufficiently low sudsing, especially when capped with a low molecular weight ($C_{1-5}$) acid or alcohol moiety, so as to minimize or eliminate the need for a suds-suppressing agent. This is highly desirable since suds-suppressing agents in general tend to act as a load on the composition and to hurt long term S/F characteristics.

(2) Polyethylene glycols having molecular weights of from about 1,400 to about 30,000, e.g., 20,000; 9,500; 7,500; 6,000; 4,500; 3,400; and 1,450. All of these materials are waxlike solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)x(C_3H_6O)y(C_2H_4O)xH$ where y equals at least 15 and $(C_2H_4O)x+x$ equals 20% of 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Preferred surfactants are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Also preferred are the low sudsing compounds of (4), the other compounds of (5), and the $C_{17-19}$ materials of (1) which have a narrow ethoxy distribution.

In addition to the above mentioned surfactants, other suitable surfactants can be found in the disclosures of U.S. Pat. Nos. 3,544,473, 3,630,923, 3,888,781 and 4,001,132, all of which are incorporated herein by reference.

Other Ingredients

In addition to the above ingredients it may be desirable, if the product sudses too much, to incorporate one of the many suds-suppressing ingredients disclosed in the above mentioned patents, which have been incorporated by reference, at a level of from about 0.001% to about 10%, preferably from about 0.05% to about 3%. The preferred suds suppressing materials are mono- and distearyl acid phosphates; the self-emulsified siloxane suds-suppressors of pending U.S. Patent Application Ser. No. 841,078, filed Oct. 11, 1977, by T. W. Gault and Edward John McGuire, Jr. and mixtures thereof. In general, lower amounts of, or no, suds-suppressors are preferred. Less than 0.2%, preferably less than 0.1% is desirable, more preferably none for best S/F, long term.

The compositions should contain less than about 10%, more preferably less than about 5%, and most preferably none of materials which have a pH greater than 12 at a concentration of 1% in water. Such materials are conventional components of automatic dishwashing compositions such as sodium metasilicate and sodium hydroxide. The content of such materials should be kept to the bare minimum for safety reasons.

Similarly, there should be no more than about 10%, preferably no more than about 5% and preferably no organic sequestering builders in the compositions. The presence of organic builders hurts the S/F performance of these compositions as disclosed in the copending U.S. Patent application of Gilbert et al, Ser. No. 849,132, filed Nov. 7, 1977, for Alkaline Dishwasher Detergent, said application being incorporated herein by reference.

China protecting agents including aluminosilicates, aluminates, etc., may be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

Spotting/Filming

Two test knives and four test glasses (Libbey Safe Edge 10 oz. tumblers No. 553) were added to the automatic dishwashers in predetermined (the same for all tests) positions (in the upper rack for the glasses and in the silver basket for the knives). Thirty-five grams of 4:1 weight mixture of shortening and dry milk were placed in a 50 ml. beaker and inverted in the top rack of the dishwasher. The required amount of detergent product was then added to the dispenser cup. Subsequently, at the main wash of the cycle, 7.5 grams more of the 4:1 weight mixture of shortening and dry milk were added. The test consisted of four washer cycles conducted in three types of dishwashers whereby four glasses and two knives from each dishwasher were graded at the end of the 2nd, 3rd, and 4th cycles. The levels of spotting and filming performance in glasses were appraised with the aid of a 1–10 scale of photographic standards (separate standards for spotting/filming) wherein 1 represents a completely unacceptable level of performance and 10 represents a performance whereby residual spotting and filming do not occur. The seventy-two grades (thirty-six spotting; thirty-six filming) so obtained are averaged to determine average spotting and filming grades. The levels of spotting performance on knives (stainless steel) were appraised with the aid of a 0–4 scale of photographic standards wherein a 0 represents a completely unacceptable level of performance and 4 a performance in which residual spotting does not occur. The eighteen grades so obtained are averaged to determine the average spotting grades.

DEMONSTRATIVE EXAMPLE I SHOWING EFFECT OF pH

In this Example the standard composition contained about 26.5 parts sodium tripolyphosphate, about 22.1 parts chlorinated trisodium phosphate, about 11 parts of a 2.4 r hydrous sodium silicate (81.5) solids, about 9 parts of a 44% solids 2.0 r sodium silicate, about 13 parts of a 37.5% solids 3.2 r sodium silicate, about 9.8 parts sodium carbonate, about 2.5 parts of a low sudsing nonionic surfactant (Pluradot HA433) which is a condensation product of propylene glycol with propylene oxide and then with polyethylene oxide to have a molecular weight of about 3,700–4,200 (26% polyethylene oxide) and containing 3% monostearyl acid phosphate (0.08% in product) as a suds suppressor for use, and about 5 parts of Pluradot HA-430 (HA-433 without the suds suppressor). The balance was water. This composition had a pH of about 10.4 under use conditions (2,500 ppm concentration). To this basic composition were added sufficient amounts of hydrochloric acid or sodium hydroxide to give pHs of 10.0, 10.8, and 11.4, respectively.

These compositions were tested for spotting by the procedures described hereinbefore. The water in this test was at 130° F. and the hardness was 7–8 grains per gallon. 24 grams of product were used.

The test results were as follows:

| | 10 | 10.8 | 11.4 |
|---|---|---|---|
| Spotting Grades (LSD 95% = 0.3) | 7.4 | 8.0 | 7.7 |

As can be seen from the above, a pH of about 10.8 provides better spotting as compared to higher and lower pH's.

EXAMPLE II

Example I was repeated without the pH adjustment (pH 10.4), substituting the condensation product of one mole of an essentially pure $C_{18}$ fatty alcohol condensed with about 8¼ moles of ethylene oxide for the HA-430 and/or HA-433. The level of surfactant was 2.3, 7.3, and 9.3% respectively with 0.2 monostearyl acid phosphate as suds suppressor. The full scale S/F results were as follows:

| Surfactant Level | Spotting/Filming (Glasses) |
|---|---|
| 2.3 | 6.9/6.7 |
| 7.3 | 7.9/6.9 |
| 9.3 | 7.3/6.6 |

As can be seen from the above, lower and higher levels of surfactant give poorer S/F results.

EXAMPLE III

Demonstrative Example Showing Effect of Wet/Dry Silicate on Agglomeration and Cup-Caking In this example, several variations using 22.7 to 31.4 parts of a 2.0 r/3.2 r (1:1) wet silicate system and 10.4 to 6.0 parts 2.4 r hydrous silicates as indicated (total $SiO_2$=12.5%) along with the standard composition containing about 26.5 parts sodium tripolyphosphate about 22.1% chlorinated trisodiumphosphate, about 10.0% sodium carbonate, about 2.5% of Pluradot HA-433 and about 5% of Pluradot HA-430 were processed identically to show the effect that wet/dry silicate ratio has on agglomeration and cup-caking.

The following table lists the silicate system and the results on agglomeration and cup-caking:

| Silicate | | Agglomeration[1] | Cup-Caking[2] |
|---|---|---|---|
| 2.0r/3.2r wet | 2.4r hyd | % on 14/% on 28 | 3/5/7 mls |
| 31.4 | 6.0 | 33/83 | 6/0/2 |
| 28.5 | 7.4 | 41/88 | 0/0/0 |
| 25.6 | 8.9 | 41/81 | 0.5/0.5/0.5 |
| 22.7 | 10.4 | 24/63 | 5/6/6 |

[1]Product was screened through various mesh sizes with the % on 14 and % on 28 reported.

[2]This test was designed as a means of measuring the ability of a product to be washed from the detergent cup. It simulates the tendency of product to cake in the machine. The three figures are grades based on 0–8 scale in which 0 is total removal and 8 is essentially no removal, for product which has been moistened with 3, 5, and 7 mls. of water respectively.

As can be seen from the above, a balance of hydrous and wet silicates is needed for processing and physical characteristics. If anhydrous silicate is used in place of the hydrous silicate, there is increased risk of forming insolubles.

When in the above Examples, the following surfactants are substituted for the indicated surfactants substantially equivalent results are obtained: Plurafac RA-40 (a $C_{13.3}$ linear alcohol ethoxylated with about 3.86 moles of ethylene oxide and the condensation product thereof reacted with about 9 moles of propylene oxide); a mixture of 14 and 15 carbon alcohols ethoxylated with 17 moles of ethylene oxide and then propoxylated with 3 moles of propylene oxide; a mixture of $C_{12}$ and $C_{13}$ alcohols ethoxylated with 6 moles of ethylene oxide and then propoxylated with 6 moles of propylene oxide; a mixture of $C_{14}$ and $C_{15}$ fatty alcohols ethoxylated with 12 moles of ethylene oxide and then propoxylated with 6 moles of propylene oxide; a $C_{15}$ alcohol ethoxylated with 9 moles of ethylene oxide and then capped with a methyl group; polyethylene glycol having a molecular weight of about 4,000; and stearic acid condensed with about 9 moles of ethylene oxide.

When in the above Examples, sodium or potassium pyrophosphate is substituted for the sodium tripolyphosphate substantially equivalent results are obtained.

What is claimed is:

1. An automatic dishwashing composition providing optimum cleaning; spotting and filming; and physical characteristics consisting essentially of:

(1) from about 20% to about 60% of a detergency builder selected from the group consisting of alkali metal tripolyphosphates, pyrophosphates, orthophosphates, carbonates and mixtures thereof; (2) from about 30% to about 38% alkali metal silicate providing from about 10% to about 15% of $SiO_2$ the silicate being a mixture of alkali metal silicates of which (a) from about 6% to about 15%, based on the total formula is present as hydrous silicate having an $SiO_2$:$M_2O$ ratio of from about 2.0 r to about 3.2 r and a solids content of from about 75% to about 85%, and (b) the remainder of the silicate is a mixture of 2.0 r and 3.0 r to 3.6 r silicates with from about 15% to about 50% of the total silicate being provided by the 2.0 r silicate, and from about 10% to about 50% of the total $SiO_2$ being provided by the higher ratio silicate, and wherein M is selected from the group consisting of sodium and potassium; (3) available chlorine at a level of from about 0.5% to about 3%; and (4) from about 5.5% to about 9.5% of a low foaming nonionic surfactant said composition having a pH of from about 10.4 to 10.9 at 2,500 ppm and being substantially free of materials having a pH of 12 or more at a concentration of 1% in water and organic chelating builders.

2. The composition of claim 1 which is completely free of materials having a pH of 12 or more at a concentration of 1% in water.

3. The composition of claim 1 which is completely free of organic chelating builders.

4. The composition of claim 3 which is completely free of materials having a pH of 12 or more at a concentration of 1% in water.

5. The composition of claim 4 containing available chlorine at a level of from about 0.7% to about 1.5%.

6. The composition of claim 5 containing from about 6% to about 8% of a low foaming nonionic surfactant.

7. The composition of claim 6 containing from about 6.5% to about 7.5% of a low foaming nonionic surfactant.

8. The composition of claim 5 containing from about 12% to about 13% of $SiO_2$ as sodium silicate.

9. The composition of claim 5 containing from about 20% to about 35% of sodium tripolyphosphate.

10. The composition of claim 5 wherein the trisodium orthophosphate is in the form of chlorinated trisodium phosphate.

11. The composition of claim 10 wherein the nonionic surfactant is present at a level of from about 6% to about 8%.

12. The composition of claim 11 wherein the nonionic surfactant is present at a level of from about 6.5% to about 7.5%.

13. The composition of claim 5 wherein the available chlorine is added by way of a sodium or potassium dichloroicynurate.

14. The composition of claim 1 containing from about 6% to about 8% of the low foaming nonionic surfactant.

15. The composition of claim 14 wherein the low foaming nonionic surfactant is present at a level of from about 6.5% to about 7.5%.

16. The composition of claim 14 containing available chlorine at a level of from about 0.7% to about 1.5%.

17. The composition of claim 16 wherein the trisodium orthophosphate is present as chlorinated trisodium phosphate.

18. The composition of claim 14 containing from about 12% to about 13% of $SiO_2$ as sodium silicate.

* * * * *